US009446422B2

(12) United States Patent
Jones

(10) Patent No.: US 9,446,422 B2
(45) Date of Patent: Sep. 20, 2016

(54) ADHESIVE DISPENSING MODULE AND METHOD OF SPRAYING A PLURALITY OF DROPLETS OF A LIQUID ADHESIVE

(71) Applicant: Nordson Corporation, Westlake, OH (US)

(72) Inventor: John D. Jones, Cranston, RI (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 14/618,092

(22) Filed: Feb. 10, 2015

(65) Prior Publication Data

US 2016/0228896 A1 Aug. 11, 2016

(51) Int. Cl.

| | |
|---|---|
| ***A62C 5/02*** | (2006.01) |
| ***B05B 7/04*** | (2006.01) |
| ***B05B 1/34*** | (2006.01) |
| ***B05B 15/00*** | (2006.01) |
| ***B05B 1/14*** | (2006.01) |
| ***B05B 1/00*** | (2006.01) |
| ***B05B 7/08*** | (2006.01) |
| ***B05B 7/06*** | (2006.01) |
| ***B05B 1/30*** | (2006.01) |

(52) U.S. Cl.

CPC ..... *B05B 7/0416* (2013.01); *B05B 1/005* (2013.01); *B05B 1/14* (2013.01); *B05B 1/3046* (2013.01); *B05B 1/34* (2013.01); *B05B 7/04* (2013.01); *B05B 7/06* (2013.01); *B05B 7/0815* (2013.01); *B05B 15/008* (2013.01)

(58) Field of Classification Search

CPC ..... B05B 7/0416; B05B 1/34; B05B 7/0815; B05B 1/005; B05B 7/04; B05B 7/06; B05B 1/3046; B05B 15/008; B05B 1/14

USPC ..... 239/8, 422, 423, 424, 424.5, 407, 239/416.5, 417.3, 590–590.5, 583, 290, 239/296, 298

See application file for complete search history.

(56) References Cited

U.S. PATENT DOCUMENTS

| | | | | |
|---|---|---|---|---|
| 2,645,527 | A | 7/1953 | Walters et al. | |
| 5,169,070 | A * | 12/1992 | Mattson | B05B 7/0081 239/590 |
| 6,012,647 | A | 1/2000 | Ruta et al. | |
| 6,082,637 | A | 7/2000 | Ludwig | |

(Continued)

FOREIGN PATENT DOCUMENTS

| | | |
|---|---|---|
| DE | 123444 | 12/1976 |
| GB | 425382 No | 3/1935 |
| GB | 1522013 A | 8/1978 |

OTHER PUBLICATIONS

Extended European search report in corresponding EPO App. No. 16152931.8, dated Jun. 20, 2016 (6 pages).

*Primary Examiner* — Steven J Ganey

(74) *Attorney, Agent, or Firm* — Baker & Hostetler LLP

(57) ABSTRACT

An adhesive dispensing module and method of spraying a plurality of droplets of a liquid adhesive includes a dispenser assembly and a nozzle. The nozzle includes a nozzle body, a dispersion baffle, and at least one channel. The nozzle body includes a nozzle outlet for discharging a liquid adhesive and at least partially defines a gas inlet, a gas outlet, and a gas passage extending therebetween. The dispersion baffle is positioned within the gas passage to define a dispersion chamber and a consolidation chamber. The at least one channel extends through the dispersion baffle to fluidly connect the dispersion chamber to the consolidation chamber to restrict the pressurized gas received within the dispersion chamber and distribute the pressurized gas into the consolidation chamber according to a predetermined flow distribution. Thereby, the pressurized gas sprays a plurality of droplets of the liquid adhesive according to a predetermined pattern.

24 Claims, 6 Drawing Sheets

(56) References Cited

U.S. PATENT DOCUMENTS 6,170,759 B1 * 1/2001 Meyer ..... B05B 7/0861 239/417.3

6,811,095 B2 * 11/2004 Donley ..... B05B 7/0861 239/296

2005/0095365 A1 5/2005 Acum et al.

* cited by examiner

ADHESIVE DISPENSING MODULE AND METHOD OF SPRAYING A PLURALITY OF DROPLETS OF A LIQUID ADHESIVE

TECHNICAL FIELD

The present invention relates generally to an adhesive dispensing module and method of spraying a plurality of droplets of a liquid adhesive with a pressurized gas, and more particularly, to a nozzle for spraying a liquid adhesive with a pressurized gas according to a predetermined pattern.

BACKGROUND

Dispensing modules are commonly used to dispense viscous liquids, such as hot melt liquid adhesives, in a variety of dispensing applications for manufacturing products and product packaging. Conventional dispensing modules include a dispensing assembly having either an electrically actuated valve assembly or an electro-pneumatically actuated valve assembly that regulates a flow and discharge of the liquid adhesive from the dispensing module. The valve includes a valve element that is moveable within the dispensing assembly for selectively displacing a needle tip relative to a valve seat within a nozzle of the dispensing module. In turn, the liquid adhesive discharges from the nozzle. The nozzle also receives a pressurized gas and discharges the pressurized gas about the liquid adhesive for spraying the liquid adhesive as a plurality of droplets according to a pattern, such as a circular pattern.

Conventional nozzles often receive the pressurized gas through a gas inlet asymmetrically positioned within the nozzle for routing the pressurized gas through the dispensing module and toward the nozzle. While such routing may be convenient for circumventing the valve element projecting through a central portion of the nozzle, the pressurized gas tends to flood the nozzle unevenly. More particularly, the pressurized gas flowing toward the gas outlet is susceptible to inconsistent air velocities and inconsistent pressure distributions as the pressurized gas approaches the gas outlet. For example, the gas inlet may be positioned at one end of a gas passage and must flow laterally across the valve before then flowing axially toward a gas outlet of the nozzle. As such, a flow of the pressurized gas rushing toward the gas outlet on one lateral side of the valve may be traveling at a different velocity than a flow of the pressurized gas rushing toward the gas outlet on an opposing lateral side of the valve.

In contrast to the pressurized gas, the liquid adhesive discharges from the nozzle generally consistently and uniformly. Thus, as the pressurized gas of differing velocities impacts the liquid adhesive, the droplets of liquid adhesive spray from the nozzle in an inconsistent pattern that differs from the intended pattern. For example, the intended pattern may be circular, but the final pattern may be irregular and/or uneven.

There is a need for an adhesive dispensing module and method of spraying a liquid, such as a hot melt liquid adhesive, that generates a consistent, predetermined spray pattern of liquid droplets that addresses present challenges and characteristics such as those discussed above.

SUMMARY

An exemplary embodiment of an adhesive dispensing module includes a dispenser assembly and a nozzle. The dispenser assembly has a liquid supply passage and a gas supply passage configured to respectively receive a liquid adhesive and a pressurized gas. The nozzle is connected to the dispenser assembly and includes a nozzle body. The nozzle body includes a nozzle outlet fluidly connected to the liquid supply passage for discharging the liquid adhesive therefrom. In addition, the nozzle at least partially defines a gas inlet, a gas outlet, and a gas passage extending therebetween. The gas inlet is fluidly connected to the gas supply passage to receive the pressurized gas therefrom. The gas outlet is positioned proximate to the nozzle outlet for directing the pressurized gas toward the liquid adhesive discharged from the nozzle outlet.

The nozzle also includes a dispersion baffle and at least one channel extending through the dispersion baffle. The dispersion baffle is positioned within the gas passage to define a dispersion chamber and a consolidation chamber. The dispersion chamber is configured to receive the pressurized gas from the gas inlet, whereas the consolidation chamber is fluidly connected to the gas outlet. The at least one channel extends through the dispersion baffle to fluidly connect the dispersion chamber to the consolidation chamber. The at least one channel is configured to restrict the pressurized gas received within the dispersion chamber and distribute the pressurized gas into the consolidation chamber according to a predetermined flow distribution. Thereby, the pressurized gas sprays a plurality of droplets of the liquid adhesive according to a predetermined pattern.

In use, a method of spraying a plurality of droplets of a liquid adhesive with a pressurized gas from a nozzle includes restricting the pressurized gas flowing through the gas passage with the at least one channel extending through the dispersion baffle. In addition, the method includes distributing the pressurized gas within the dispersion chamber and introducing the pressurized gas into the consolidation chamber according to a predetermined flow distribution. The method also includes directing the predetermined flow distribution of the pressurized gas through the consolidation chamber and toward the liquid adhesive. Furthermore, the method includes spraying the plurality of droplets of the liquid adhesive in a predetermined pattern with the predetermined flow distribution of the pressurized gas.

Various additional objectives, advantages, and features of the invention will be appreciated from a review of the following detailed description of the illustrative embodiments taken in conjunction with the accompanying drawings.

DETAILED DESCRIPTION

Figure 1:
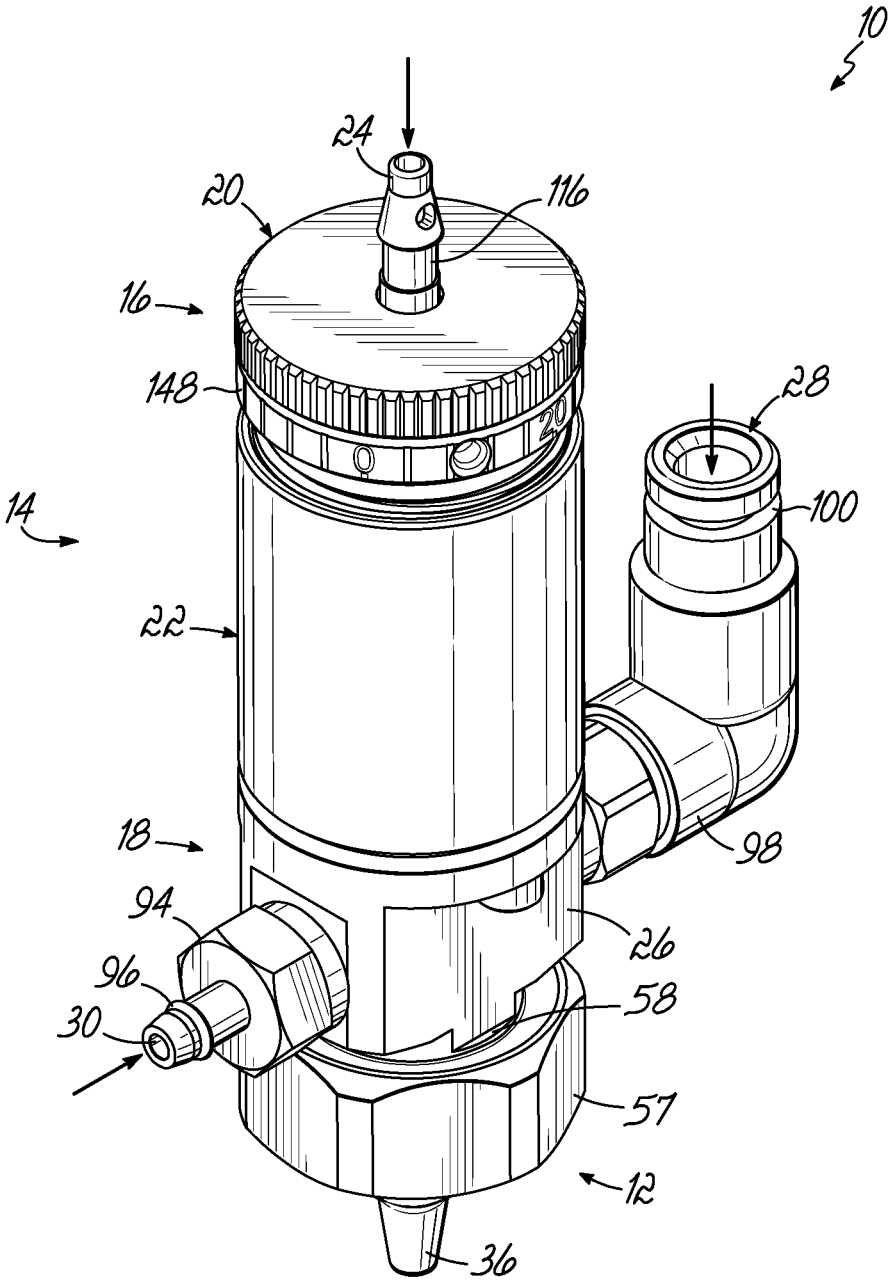
FIG. 1 is a perspective view of an adhesive dispensing module according to the invention described herein.

With reference to FIG. 1, an exemplary embodiment of an adhesive dispensing module 10 for dispensing a viscous liquid, such as a hot melt liquid adhesive, includes a nozzle 12 removably connected to a dispenser assembly 14. The dispenser assembly 14 more particularly includes an upper portion 16 and a lower portion 18, which connects to the nozzle 12. The upper portion 16 includes a capstroke knob 20 and a cylinder assembly 22. The capstroke knob 20 and the cylinder assembly 22 operatively connect to a valve element 21 (see FIG. 3) that extends from the cylinder assembly 22, through the lower portion 18, and into the nozzle 12. The upper portion 16 also includes an upper gas supply port 24 fluidly connected to the cylinder assembly 22 for operating the valve element 21 (see FIG. 3). The lower portion 18 includes a fluid body 26, which receives a pressurized gas and a liquid adhesive from a lower gas supply port 28 and a liquid supply port 30, respectively. The nozzle 12 fluidly connects to the fluid body 26 such that the valve element 21 (see FIG. 3) discharges the liquid adhesive from the nozzle 12 and the pressurized gas further dispenses the liquid adhesive from the nozzle 12 as a plurality of droplets in the form of a predetermined pattern, such as a generally circular pattern. As used herein, it will be appreciated that the terms "upper" and "lower" are intended provide relative locations along exemplary the exemplary embodiment of the adhesive dispensing module 10. It is not intended that the term "distal" and "proximal" limit the invention to the exemplary embodiment described herein.

Figure 2:
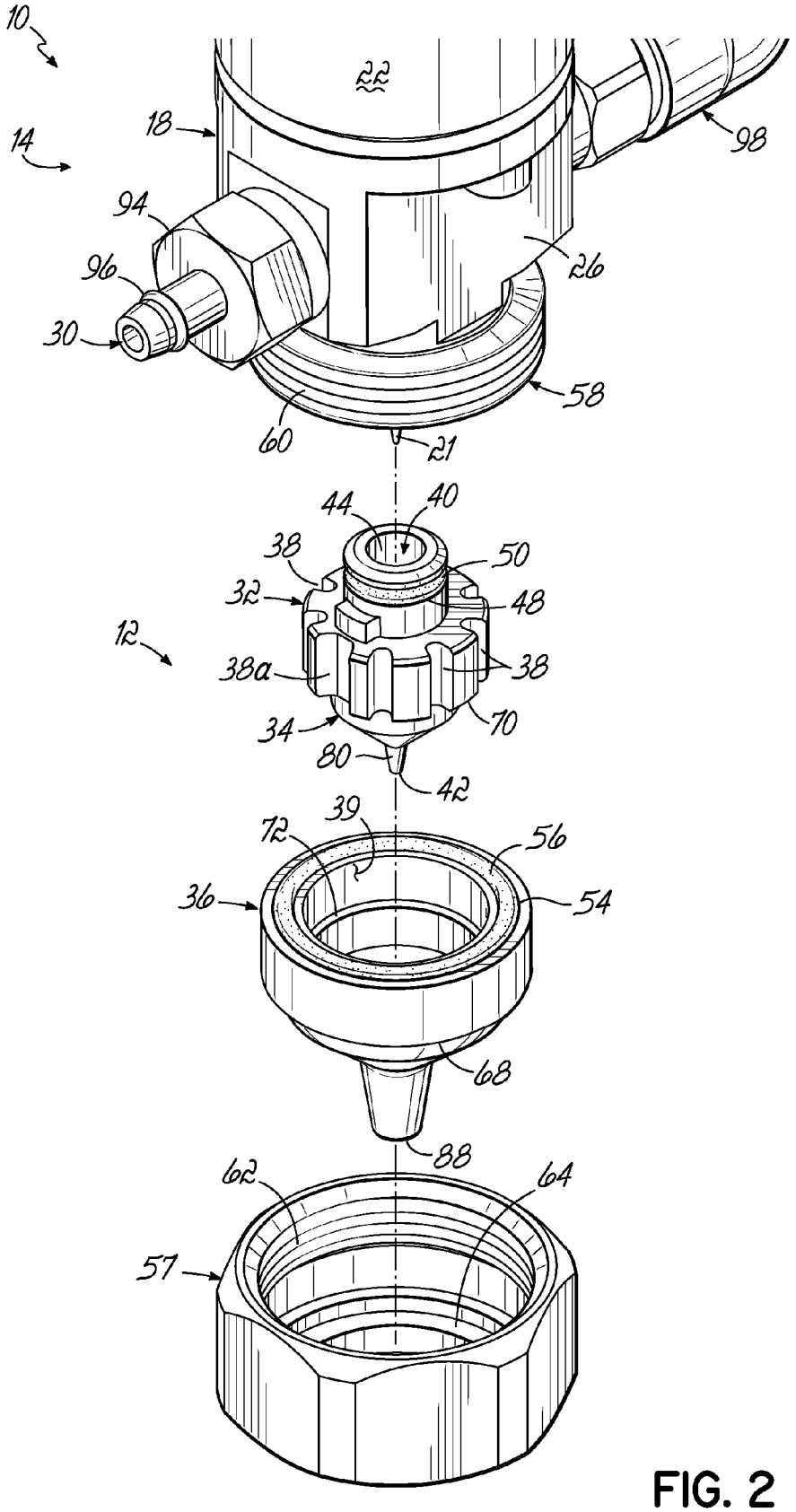
FIG. 2 is an exploded perspective view of a nozzle shown in FIG. 1.

In order to dispense the plurality of droplets in the predetermined pattern, the nozzle 12 shown in FIG. 2 includes a dispersion baffle 32, a nozzle body 34, and a nozzle cap 36. The dispersion baffle 32 includes a plurality of channels 38 for restricting pressurized gas and distributing the pressurized gas according to a predetermined flow distribution. According to the exemplary embodiment discussed below in additional detail, the plurality of channels 38 are positioned about a circumference of the dispersion baffle 32 and sized such that the pressurized gas flowing therealong distributes in a generally equalized flow distribution about the dispersion baffle 32. The plurality of channels 38 shown in FIG. 2 are further defined by an inner surface 39 of the nozzle cap 36. However, it will be appreciated that one or more of the plurality of channels 38 may alternatively be defined by only the dispersion baffle 32. In further accordance with the exemplary embodiment, the dispersion baffle 32 is in the form of an annular ring dispersion baffle 32 that surrounds the nozzle body 34. More specifically, the annular ring dispersion baffle 32 is integral and unitarily formed with the nozzle body 34. However, it will be appreciated that the dispersion baffle 32 may alternatively be separate and independently formed from the nozzle body 34. The nozzle 12 is thus not necessarily intended to be limited to the integral and unitarily formed dispersion baffle 32 and nozzle body 34 shown and described herein.

The nozzle body 34 includes a liquid inlet 40, a liquid outlet 42 opposite the liquid inlet 40, and a liquid passage 44 extending therebetween. The nozzle body 34 includes an upper annular end portion 46 having an annular groove 48 that receives a nozzle seal 50. In addition, the nozzle cap 36 includes an upper surface 52 having an annular recess 54 that receives another nozzle seal 56. Each of the nozzle seals 50, 56 fluidly seal against the fluid body 26. More particularly, the nozzle seal 50 fluidly seals the liquid adhesive from the pressurized gas, whereas the other nozzle seal 56 fluidly seals the pressurized gas from an exterior environment. According to an exemplary embodiment, the nozzle seals 50, 56 are o-ring seals. However, it will be appreciated that alternative seals may be used for fluidly sealing the nozzle body 34 to the fluid body 26.

The nozzle 12 further includes a retainer 57 for removable connection with the fluid body 26. The fluid body 26 has a nozzle adapter 58 projecting therefrom that has exterior threads 60 that cooperate with interior threads 62 of the retainer 57. Thereby, the retainer 57 threadably engages the fluid body 26 to capture the nozzle cap 36, the nozzle body 34, and the dispersion baffle 32 therebetween. More particularly, the retainer 57 has a collar 64 defining an opening 66 (see FIG. 4) that receives a portion of the nozzle cap 36 such that the collar 64 engages a lower surface 68 of the nozzle cap 36 to nest the nozzle cap 36 within the retainer 57. Similarly, at least one of the dispersion baffle 32 and the nozzle body 34 has a lip 70 that engages an interior collar 72 of the nozzle cap 36. According to the exemplary embodiment, an outer portion of the dispersion baffle 32 defines the lip 70 supported on the interior collar 72 such that the dispersion baffle 32 and the nozzle body 34 also nest within the nozzle cap 36. Thereby, each of the nozzle body 34, the dispersion baffle 32, and the nozzle cap 36 nest within the retainer 57 and compresses against the fluid body 26 to effectively seal the nozzle 12 against the fluid body 26 via the first and second seals 50, 56.

Figure 3:
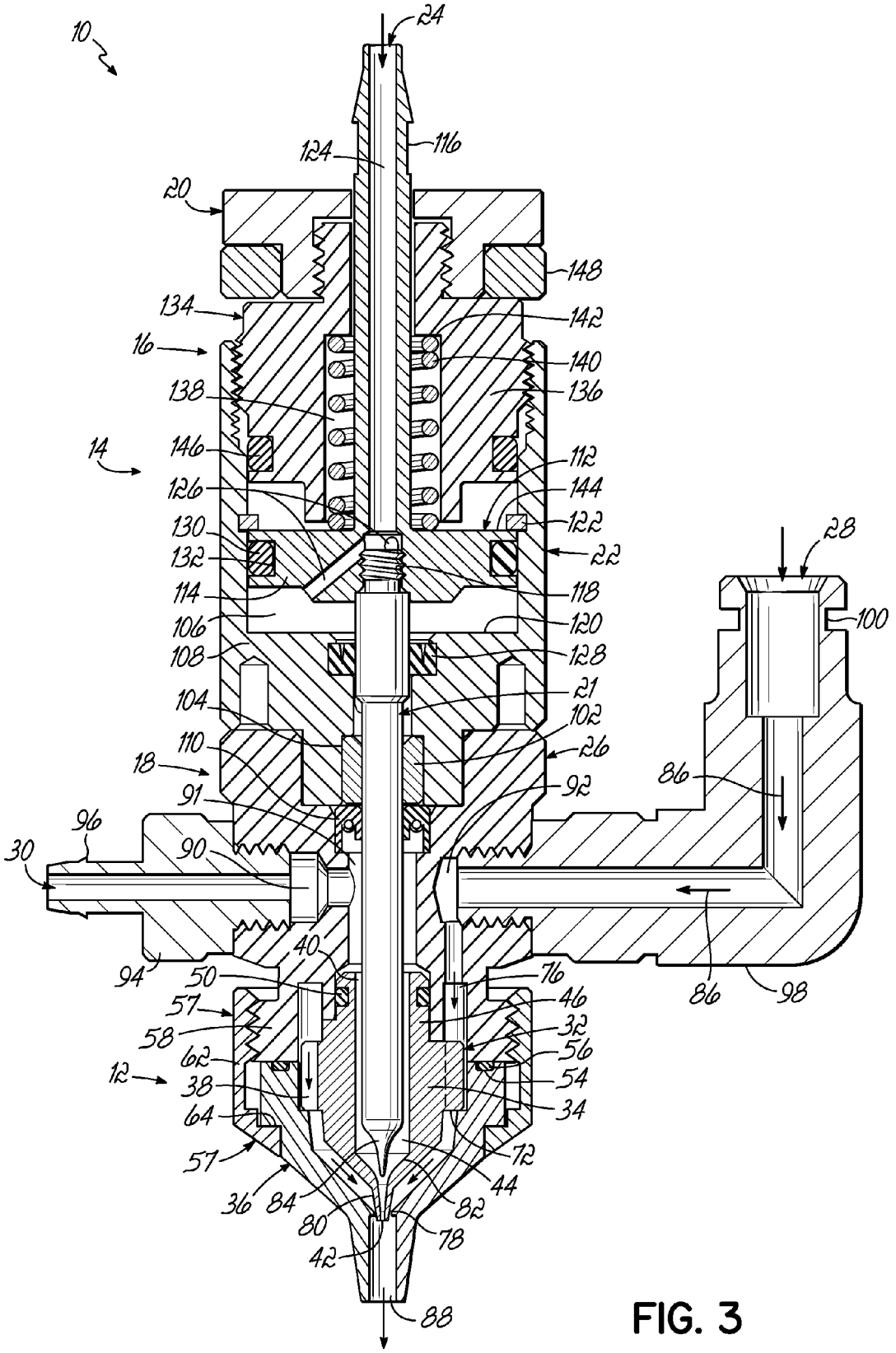
FIG. 3 is a cross-section view of the adhesive dispensing module of FIG. 1 taken along section line 3-3.

With respect to FIG. 3, the dispersion baffle 32 rests on the interior collar 72 of the nozzle cap 36 such that the nozzle body 34 is suspended within the nozzle cap 36. As such, an outer surface of the nozzle body 34 and an inner surface of the nozzle cap 36 define a gas passage 74 therebetween. The gas passage 74 is further defined by an inner surface of the nozzle adapter 58 and extends from a gas inlet 76 for receiving pressurized gas within the nozzle 12 to a gas outlet 78. A tip portion 80 of the nozzle body 34 also projects through the gas outlet 78 to further define the gas outlet 78 as an annular gas outlet 78 that surrounds the tip portion 80.

The tip portion 80 of the nozzle body 34 includes a generally frustoconical valve seat 82 within the liquid passage 44. A needle tip 84 of the valve element 21 selectively moves from a lower sealed position against the valve seat 82, which blocks the liquid outlet 42, to an upper unsealed position that permits the passage of the liquid adhesive through the liquid outlet 42. Once discharged from the liquid outlet 42, a flow of the pressurized gas, indicated by arrows 86, surrounds the liquid adhesive and sprays the liquid adhesive in the form of droplets along a nozzle outlet passage 88 of the nozzle cap 36. According to the exemplary embodiment, the liquid outlet 42 is surrounded by and concentric with the gas outlet 78. In addition, the nozzle outlet passage 88 concentrically surrounds the liquid outlet 42 such that the liquid outlet 42, the gas outlet 78, and the nozzle outlet passage 88 are axially aligned with each other.

With continued reference to FIG. 3, a liquid supply passage 90 provided in the dispenser assembly 14 extends from the liquid supply port 30 and about the valve element 21 along an annular flow passageway 91 disposed between a length of the valve element 21 and the nozzle adapter 58. The annular flow passageway 91 thus fluidly connects to the liquid passage 44 of the nozzle body 34 to receive the liquid adhesive through the liquid inlet 40. A gas supply passage 92 provided in the dispenser assembly 14 extends from the lower gas supply port 28 to the gas inlet 76 of the nozzle 12 for fluidly communicating the pressurized gas to the nozzle 12. According to the exemplary embodiment, the liquid supply port 30 is defined by a threaded coupling 94 having a barbed end portion 96 configured to fluidly seal against a conduit (not shown) in fluid communication with a liquid adhesive supply. In addition, the lower gas supply port 28 is defined by another threaded coupling 98 having a grooved end portion 100 configured to fluidly seal against another conduit (not shown) in fluid communication with a gas supply.

Furthermore, the cylinder assembly 22 is configured to selectively move the valve element 21 and guide the valve element 21 back and forth between the sealed and unsealed positions via a needle guide 102. To this end, the needle guide 102 is press fit into a bore 104 extending from a cylinder chamber 106 to a base 108 of the cylinder assembly 22. The base 108 abuts against the fluid body 26 such that the bore 104 and the annular flow passageway 91 axially align. More particularly, the needle guide 102 abuts against a hydraulic sealing element 110 configured to inhibit liquid adhesive from flowing beyond the fluid body 26 and into the bore 104 toward the cylinder chamber 106.

In addition to the cylinder chamber 106, the cylinder assembly 22 further includes a piston 112 having a piston head 114 and a stem 116 disposed therein. A threaded end portion 118 of the valve element 21 extends through the cylinder chamber 106 and threadably secures to a central portion of the piston head 114. The piston head 114 is movable between a lower position, which is bounded by a bottom 120 of the cylinder chamber 106, and an upper position, which is bounded by a retaining ring 122. The stem 116 defines a primary supply conduit 124 extending from the upper gas supply port 24 and into the piston head 114. In addition, a plurality of head supply conduits 126 extend through the piston head 114 to fluidly connect the primary supply conduit 124 to the cylinder chamber 106. Thereby, the gas supply (not shown) selectively pressurizes the cylinder chamber 106 to force the piston head 114 and, in turn, the valve element 21, to the upper and unsealed positions, respectively. For example, the gas supply (not shown) may be selectively regulated by a valve, such as a solenoid valve, to control the supply of pressurized gas to the cylinder chamber 106. According to the exemplary embodiment, another hydraulic sealing element 128 is positioned about the valve element 21 within the base 108 for inhibiting pressurized gas from flowing along the valve element 21 and toward the fluid body 26. Similarly, the piston head 114 receives a piston seal 130 within an annular head groove 132 for inhibiting pressurized gas from leaking around the piston head 114. Thereby, the cylinder chamber 106 is generally fluidly sealed between the piston 112 and the bottom 120 of the cylinder assembly 22.

The cylinder assembly 22 also includes a return mechanism 134 to force the piston head 114 downward to the bottom 20 of the cylinder assembly 22. The return mechanism 134 includes a fixed position sleeve 136 defining a cylindrical hole 138 and a biasing element 140, such as a spring 140, received within the cylindrical hole 138. The fixed position sleeve 136 threadably engages the upper portion 16 and covers the piston head 114. The spring 140 is thereby compressed within the cylindrical hole 138 between an inner sleeve surface 142 of the fixed position sleeve 136 and a top 144 of the piston head 114. According to the exemplary embodiment, the spring 140 is inserted onto the stem 116 of the piston 112 such that the spring 140 is captured within the cylindrical hole 138. It will be appreciated that an alternative biasing element and/or biasing assembly may be used for forcing the piston head 114 and, in turn, the valve element 21 toward the lower and sealed positions, respectively. In addition, the return mechanism 134 includes an annular sleeve seal 146 surrounding the fixed position sleeve 136 to inhibit pressurized gas that may leak past the piston seal 130 from flowing beyond the fixed position sleeve 136 and into the exterior environment.

The exemplary embodiment of the dispenser assembly 14 has the capstroke knob 20 threadably secured to an upper end portion of the fixed position sleeve 136. The capstroke knob 20 has a stroke control 148 operatively connected to the stem 116 proximate to the upper gas supply port 24 for adjusting a stroke length of the piston 112 and valve element 21 as will be appreciated by one of ordinary skill in the art. To this end, the exemplary dispenser assembly 14 is configured to receive the exemplary nozzle 12 for dispensing droplets of liquid adhesive. However, it will be appreciated that alternative dispenser assemblies may be used with the nozzle 12 for dispensing any types of viscous liquid, such as liquid adhesive. Therefore, the invention described herein is not necessarily intended to be limited to the dispenser assembly 14 shown and described herein.

Figure 4:
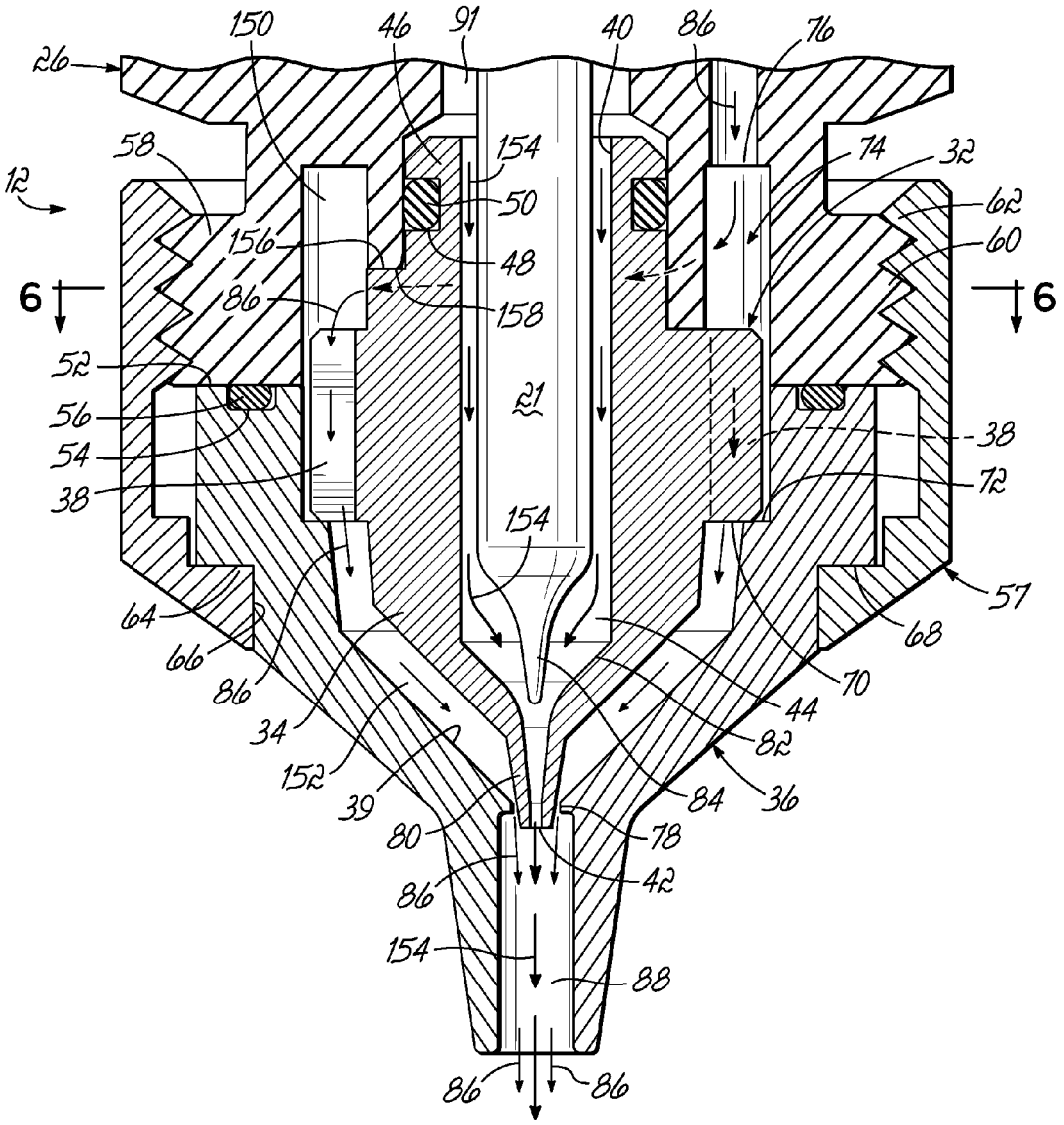
FIG. 4 is an enlarged cross-section view of the nozzle shown in FIG. 3.

As shown in FIG. 4, the dispersion baffle 32 divides the gas passage 74 to define a dispersion chamber 150 upstream of the dispersion baffle 32 and a consolidation chamber 152 downstream of the dispersion baffle 32. According to the exemplary embodiment, the nozzle adapter 58, the nozzle body 34, and the dispersion baffle 32 collectively define the dispersion chamber 150. In contrast, the nozzle body 34, the nozzle cap 36, and the dispersion baffle 32 collectively define the consolidation chamber 152. In addition, the pluralities of channels 38 extend from the dispersion chamber 150 to the consolidation chamber 152 for fluid communication of pressurized gas from the dispersion chamber 150 to the consolidation chamber 152.

The gas inlet 76 introduces the flow of pressurized gas 86 into the dispersion chamber 150 asymmetrically about a central axis of the valve element 21. For example, a portion of the flow of pressurized gas 86 introduced at one end of the dispersion chamber 150 may travel further to reach the dispersion baffle 32 than another portion of the flow of pressurized gas 86. However, the plurality of channels 38 and the dispersion baffle 32 are configured to restrict the flow of the pressurized gas 86 in order to generally equalize the pressure of the flow across dispersion baffle 32. In turn, the plurality of channels 38 receive the flow of the pressurized gas 86 from the dispersion chamber 150 and introduce the flow of the pressurized gas 86 into the consolidation chamber 152 with a generally equalized flow distribution. Under pressure, the generally equalized flow of the pressurized gas 86 approaches the gas outlet 78 generally symmetrically and surrounds a flow of the liquid adhesive, indicated by arrows 154. Because the non-uniform, asymmetrical flow of the pressurized gas 86 has been redirected to a generally uniform, symmetrical flow having the equalized pressure distribution, the flow of the pressurized gas 86 surrounding the liquid adhesive dispenses the liquid adhesive from the nozzle 12 with the predetermined, generally circular pattern. However, the plurality of channels 38 may be configured to generate an alternative predetermined pressure distribution of pressurized gas in order to spray the plurality of droplets of liquid adhesive according to another predetermined pattern. For example, the predetermined pattern may be oval or any other desirable shape for dispensing onto a substrate.

Figure 5:
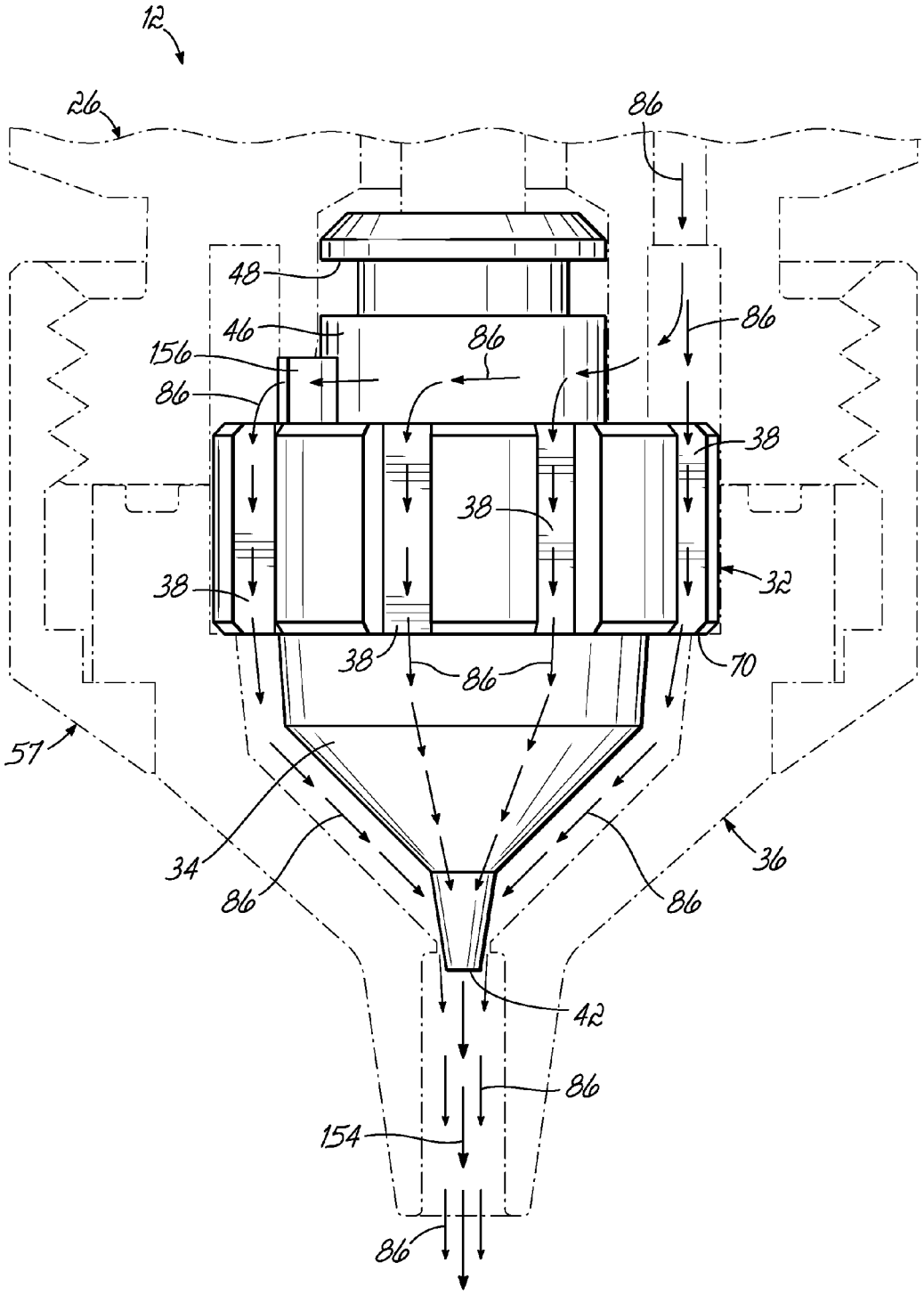
FIG. 5 is a side view of a valve body and a dispersion baffle of the nozzle shown in FIG. 4.
Figure 6:
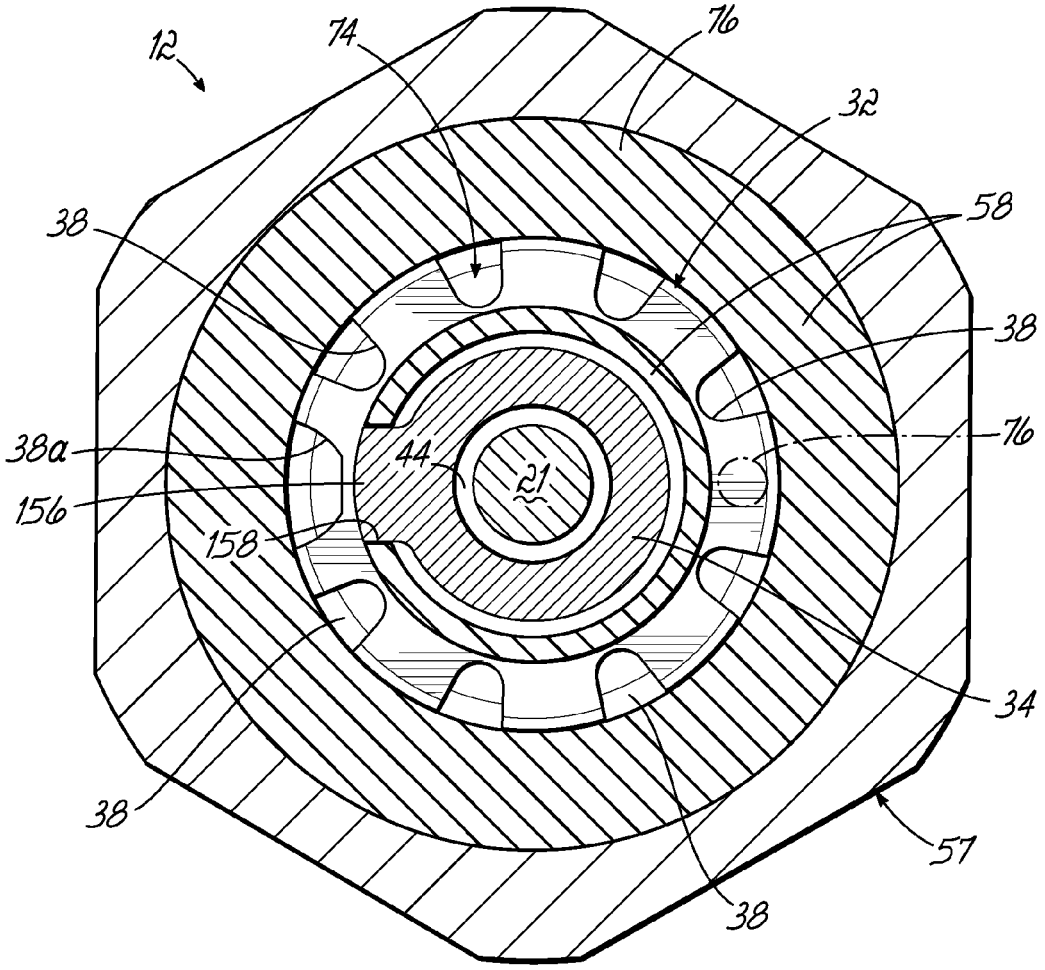
FIG. 6 is a cross-section view of the nozzle of FIG. 4 taken along section line 6-6.

With respect to FIGS. 4-6, the plurality of channels 38 extend about the dispersion baffle 32 asymmetrically in order to restrict and distribute the flow of the pressurized gas 86 generally evenly about the dispersion chamber 150. Thereby, the dispersion baffle 32 corrects the pressure and velocity inconsistencies such that the flow of the pressurized gas 86 is generally uniform through the consolidation chamber 152. In addition, the channel 38*a* opposite the gas inlet 76, as shown in FIG. 6 is generally larger than the remaining channels 38 in order to further encourage even distribution of the pressurized gas. According to the exemplary embodiment, the position of the plurality of channels 38 through the dispersion baffle 32 as shown in FIGS. 4-6 is uniquely configured to the position of the gas inlet 76 for restricting and distributing the flow of the pressurized gas 86 generally evenly. However, it will be appreciated that the positions and sizes of the plurality of channels 38 may be alternatively configured for other dispenser assemblies and gas inlets. Therefore, the position, size, and even the number of the plurality of channels 38 may vary to generate alternative flow distributions and spray patterns.

Given that the position of each of the plurality of channels 38 relative to the gas inlet 76 is uniquely configured to distribute the flow of the pressurized gas 86 as described herein, the dispersion baffle 32 is keyed to the nozzle adapter 58 to ensure proper placement upon assembly. Specifically, the dispersion baffle 32 includes a projecting key element 156, and the nozzle adapter 58 includes a recessed key element 158. The projecting key element 156 is configured to cooperate with the recessed key element 158 such that the dispersion baffle 32 is properly positioned against the nozzle adapter 58 to receive the flow of pressurized gas 86 in a predetermined position. According to the exemplary embodiment, the projecting key element 156 extends from both the dispersion baffle 32 and the nozzle body 34. However, it will be appreciated that the key elements 156, 158 may be alternatively positioned for positioning the plurality of channels 38 relative to the gas inlet 76.

In use, the adhesive dispensing module 10 shown in FIGS. 1-3 is fluidly connected to the supply of pressurized gas via the upper gas supply port 24 and the lower gas supply port 28. The adhesive dispensing module 10 also fluidly connects to the source of liquid adhesive via the liquid supply port 30. Generally, the piston 112 is biased in the lower position such that the needle tip 84 engages the valve seat 82 and fluidly seals thereagainst to inhibit the flow of liquid adhesive 154. However, pressurized gas is directed into the cylinder chamber 106 to selectively move the piston 112 from the lower position to the upper position to unseal the needle tip 84 from the valve seat 82 and discharge the liquid adhesive through the liquid outlet 42.

In addition, the pressurized gas introduced into the fluid body 26 flows through the gas supply passage 92 and beyond the gas inlet 76 for being received within the dispersion chamber 150. The dispersion baffle 32 restricts the flow of the pressurized gas 86 such that the flow of the pressurized gas 86 floods the dispersion chamber 150 and distributes the pressurized gas about the dispersion chamber 150 according to the predetermined flow distribution. According to the exemplary embodiment, the flow of the pressurized gas 86 distributes generally uniformly within the dispersion chamber 150 and then passes through the plurality of channels 38.

Once through the plurality of channels 38, the flow of pressurized gas 86 is received within the consolidation chamber 152 according to the predetermined, generally uniform flow distribution as shown in FIGS. 4-6. The flow of the pressurized gas 86 travels consistently and generally uniformly toward the gas outlet 78. The gas outlet 78 generally surrounds the liquid outlet 42 and, as such, the flow of pressurized gas 86 discharged from the gas outlet 78 similarly surrounds the liquid adhesive discharged from the liquid outlet 42. The pressurized gas thereby sprays the liquid adhesive to form the plurality of droplets as the liquid adhesive and the pressurized gas simultaneously pass through the nozzle outlet passage 88. The plurality of droplets dispensed from the adhesive dispensing module 10 scatter to define the predetermined pattern for application onto the substrate. According to the exemplary embodiment, the predetermined pattern is generally circular. However, it will be appreciated that the predetermined pattern and the predetermined flow distribution may be configured to dispense an alternative pattern of the plurality of droplets.

While the present invention has been illustrated by the description of one or more embodiments thereof, and while the embodiments have been described in considerable detail, they are not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method and illustrative examples shown and described. Accordingly, departures may be from such details without departing from the scope of the general inventive concept.

What is claimed is:

1. An adhesive dispensing module, comprising:

a dispensing assembly having a liquid supply passage configured to receive a liquid adhesive and a gas supply passage configured to receive a pressurized gas; and a nozzle connected to said dispenser assembly and including:

a nozzle body including a nozzle outlet fluidly connected to said liquid supply passage for discharging the liquid adhesive therefrom, said nozzle body at least partially defining a gas inlet, a gas outlet, and a gas passage extending therebetween, said gas inlet fluidly connected to said gas supply passage to receive the pressurized gas therefrom, and said gas outlet positioned proximate to said nozzle outlet for directing the pressurized gas toward the liquid adhesive discharged from said nozzle outlet;

a dispersion baffle positioned within said gas passage to define a dispersion chamber and a consolidation chamber, said dispersion chamber configured to receive the pressurized gas from said gas inlet as an asymmetrical flow of gas with respect to a central axis of said dispersion chamber, and said consolidation chamber fluidly connected to said gas outlet; and at least one channel extending through said dispersion baffle to fluidly connect said dispersion chamber to said consolidation chamber, said at least one channel configured to restrict the pressurized gas received within said dispersion chamber and distribute the pressurized gas into said consolidation chamber according to a predetermined flow distribution for spraying a plurality of droplets of the liquid adhesive according to a predetermined pattern.

2. The adhesive dispensing module of claim 1, wherein said predetermined flow distribution is a generally equalized flow distribution throughout said consolidation chamber for spraying the plurality of droplets according to a generally circular pattern.

3. The adhesive dispensing module of claim 1, wherein said dispersion baffle is an annular ring dispersion baffle, and said annular ring dispersion baffle generally surrounds said nozzle body.

4. The adhesive dispensing module of claim 3, wherein said annular ring dispersion baffle is integral and unitarily formed with said nozzle body.

5. The adhesive dispensing module of claim 1, wherein said at least one channel is configured to restrict the pressurized gas received within said dispersion chamber to generally equalize a pressure of the pressurized gas therein and distribute the pressurized gas into said consolidation chamber according to a generally uniform flow distribution.

6. The adhesive dispensing module of claim 1, further comprising:

a nozzle cap configured to cover at least a portion of said nozzle body and further define said gas passage therebetween.

7. The adhesive dispensing module of claim 6, wherein said nozzle cap is configured to further define said at least one channel extending along said dispersion baffle.

8. The adhesive dispensing module of claim 6, wherein said dispenser assembly includes a fluid body and said nozzle includes a retainer removably connected to said fluid body such that said nozzle cap and said nozzle body are captured between said fluid body and said retainer to removably secure and fluidly seal said nozzle body and said nozzle cap against said fluid body.

9. The adhesive dispensing module of claim 1, wherein said dispersion baffle includes a first key element and said dispensing assembly includes a second key element, and said first key element cooperates with said second key element to position said dispersion baffle relative to said dispensing assembly in a predetermined position for distributing said pressurized gas according to the predetermined flow distribution.

10. The adhesive dispensing module of claim 1, wherein said gas inlet is offset from said central axis of said dispersion chamber.

11. A nozzle for an adhesive dispensing module, the nozzle comprising:

a nozzle body including a nozzle outlet for discharging a liquid adhesive therefrom, said nozzle body at least partially defining a gas inlet, a gas outlet, and a gas passage extending therebetween, said gas outlet positioned proximate to said nozzle outlet for directing a pressurized gas toward the liquid adhesive discharged from said nozzle outlet;

a dispersion baffle positioned within said gas passage to define a dispersion chamber and a consolidation chamber, said dispersion chamber configured to receive the pressurized gas from said gas inlet as an asymmetrical flow of gas with respect to a central axis of said dispersion chamber, and said consolidation chamber fluidly connected to said gas outlet; and at least one channel extending through said dispersion baffle to fluidly connect said dispersion chamber to said consolidation chamber, said at least one channel configured to restrict the pressurized gas received within said dispersion chamber and distribute the pressurized gas into said consolidation chamber according to a predetermined flow distribution for spraying a plurality of droplets of the liquid adhesive according to a predetermined pattern.

12. The nozzle of claim 11, wherein said predetermined flow distribution is a generally equalized flow distribution throughout said consolidation chamber for spraying the plurality of droplets according to a generally circular pattern.

13. The nozzle of claim 11, wherein said dispersion baffle is an annular ring dispersion baffle, and said annular ring dispersion baffle generally surrounds said nozzle body.

14. The nozzle of claim 13, wherein said annular ring dispersion baffle is integral and unitarily formed with said nozzle body.

15. The nozzle of claim 11, wherein said at least one channel is configured to restrict the pressurized gas received within said dispersion chamber to generally equalize a pressure of the pressurized gas therein and distribute the pressurized gas into said consolidation chamber according to a generally uniform flow distribution.

16. The nozzle of claim 11, further comprising:

a nozzle cap configured to cover at least a portion of said nozzle body and further define said gas passage therebetween.

17. The nozzle of claim 16, wherein said nozzle cap further configured to define said at least one channel extending along said dispersion baffle.

18. The nozzle of claim 11, wherein said dispersion baffle includes a first key element configured to cooperate with a second key element of a dispensing assembly and position and said dispersion baffle relative to the dispensing assembly in a predetermined position for distributing said pressurized gas according to the predetermined flow distribution.

19. The nozzle of claim 11, wherein said gas inlet is offset from said central axis of said dispersion chamber.

20. A method of spraying a plurality of droplets of a liquid adhesive with a pressurized gas from a nozzle according to a predetermined pattern, the nozzle including a nozzle body and a dispersion baffle, the nozzle body and the dispersion baffle defining a dispersion chamber and a consolidation chamber within a gas passage, and at least one channel extending through the dispersion baffle to fluidly connect the dispersion and consolidation chambers, the method comprising:

restricting the pressurized gas flowing through the gas passage as an asymmetrical flow of gas with respect to a central axis of said dispersion chamber with the at least one channel extending through the dispersion baffle;

distributing the pressurized gas within the dispersion chamber and introducing the pressurized gas into the consolidation chamber according to a predetermined flow distribution;

directing the predetermined flow distribution of the pressurized gas through the consolidation chamber and toward the liquid adhesive; and spraying the plurality of droplets of the liquid adhesive in a predetermined pattern with the predetermined flow distribution of the pressurized gas.

21. The method of claim 20, further comprising:

generally equalizing a pressure of the pressurized gas within the dispersion chamber such that the predetermined flow distribution is a generally equalized flow distribution.

22. The method of claim 21, wherein the predetermined pattern of the sprayed droplet of the liquid adhesive is a generally circular pattern.

23. An adhesive dispensing module, comprising:

a dispensing assembly having a liquid supply passage configured to receive a liquid adhesive, a gas supply passage configured to receive a pressurized gas, and a fluid body; and a nozzle connected to said dispenser assembly and including:

a nozzle body including a nozzle outlet fluidly connected to said liquid supply passage for discharging the liquid adhesive therefrom, said nozzle body at least partially defining a gas inlet, a gas outlet, and a gas passage extending therebetween, said gas inlet fluidly connected to said gas supply passage to receive the pressurized gas therefrom, and said gas outlet positioned proximate to said nozzle outlet for directing the pressurized gas toward the liquid adhesive discharged from said nozzle outlet;

a nozzle cap configured to cover at least a portion of said nozzle body and further define said gas passage therebetween;

a retainer removably connected to said fluid body such that said nozzle cap and said nozzle body are captured between said fluid body and said retainer to removably secure and fluidly seal said nozzle body and said nozzle cap against said fluid body;

a dispersion baffle positioned within said gas passage to define a dispersion chamber and a consolidation chamber, said dispersion chamber configured to receive the pressurized gas from said gas inlet and said consolidation chamber fluidly connected to said gas outlet; and at least one channel extending through said dispersion baffle to fluidly connect said dispersion chamber to said consolidation chamber, said at least one channel configured to restrict the pressurized gas received within said dispersion chamber and distribute the pressurized gas into said consolidation chamber according to a predetermined flow distribution for spraying a plurality of droplets of the liquid adhesive according to a predetermined pattern.

24. An adhesive dispensing module, comprising:

a dispensing assembly having a liquid supply passage configured to receive a liquid adhesive and a gas supply passage configured to receive a pressurized gas; and a nozzle connected to said dispenser assembly and including:

a nozzle body including a nozzle outlet fluidly connected to said liquid supply passage for discharging the liquid adhesive therefrom, said nozzle body at least partially defining a gas inlet, a gas outlet, and a gas passage extending therebetween, said gas inlet fluidly connected to said gas supply passage to receive the pressurized gas therefrom, and said gas outlet positioned proximate to said nozzle outlet for directing the pressurized gas toward the liquid adhesive discharged from said nozzle outlet;

a dispersion baffle positioned within said gas passage to define a dispersion chamber and a consolidation chamber, said dispersion chamber configured to receive the pressurized gas from said gas inlet and said consolidation chamber fluidly connected to said gas outlet; and at least one channel extending through said dispersion baffle to fluidly connect said dispersion chamber to said consolidation chamber, said at least one channel configured to restrict the pressurized gas received within said dispersion chamber and distribute the pressurized gas into said consolidation chamber according to a predetermined flow distribution for spraying a plurality of droplets of the liquid adhesive according to a predetermined pattern, wherein said dispersion baffle includes a first key element and said dispenser assembly includes a second key element, and said first key element cooperates with said second key element to position said dispersion baffle relative to said dispensing assembly in a predetermined position for distributing said pressurized gas according to the predetermined flow distribution.

* * * * *